US006528758B2

(12) United States Patent
Shaffer

(10) Patent No.: US 6,528,758 B2
(45) Date of Patent: Mar. 4, 2003

(54) METHOD AND APPARATUS FOR FADING A DYED TEXTILE MATERIAL

(75) Inventor: Wayne K. Shaffer, Penfield, NY (US)

(73) Assignee: Icon Laser Technologies, Inc., Rochester, NY (US)

( * ) Notice: Subject to any disclaimer, the term of this patent is extended or adjusted under 35 U.S.C. 154(b) by 84 days.

(21) Appl. No.: 09/781,340

(22) Filed: Feb. 12, 2001

(65) Prior Publication Data

US 2002/0136558 A1 Sep. 26, 2002

(51) Int. Cl.[7] ..... B23K 26/00
(52) U.S. Cl. ..... 219/121.68; 219/121.69
(58) Field of Search ..... 219/121.61, 121.67, 219/121.68, 121.69, 121.72, 121.78, 121.8; 8/444

(56) References Cited

U.S. PATENT DOCUMENTS 5,179,262 A * 1/1993 Portney et aL.
5,567,207 A 10/1996 Lockman et al.
5,916,461 A 6/1999 Costin et al.
5,932,118 A * 8/1999 Yamamoto et al.
5,990,444 A 11/1999 Costin
6,002,099 A 12/1999 Martin et al.
6,140,602 A 10/2000 Costin

FOREIGN PATENT DOCUMENTS

JP 362296989 A * 12/1987

* cited by examiner

*Primary Examiner*—Samuel M. Heinrich
(74) *Attorney, Agent, or Firm*—Brian B. Shaw, Esq.; Stephen B. Salai, Esq.; Harter, Secrest & Emery LLP

(57) ABSTRACT

An apparatus for forming transitioned edges in patterns formed by a scanning laser in a dyed textile material is disclosed. The transition rate between the untreated material and the treated material is controlled by passing a scanning laser beam through a mask prior to the laser beam reaching a focal point. An apertured mask can be employed to control the transition rate, wherein the location of the aperture relative to the focal point of the laser beam and configuration of the aperture periphery are manipulated to effect the transition rate.

17 Claims, 6 Drawing Sheets

METHOD AND APPARATUS FOR FADING A DYED TEXTILE MATERIAL

FIELD OF THE INVENTION

The present invention relates to color fading a dyed textile material, and more particularly to selectively decreasing laser energy density per unit area adjacent the periphery of an area selected to be faded.

BACKGROUND OF THE INVENTION

A laser beam can interact with a surface in a number of ways to change the surface properties, including light absorption, photon scattering and impact. For example, a surface may be burned by an intense laser beam. Some surface particles may be ablated from a surface by the impact of a laser beam. Therefore, a surface can be treated with one or more proper lasers to achieve certain effects that may not be easily done with other methods. One example is described in a U.S. Pat. No. 5,567,207, titled "Method For Marking And Fading Textiles With Lasers", issuing on Oct. 22, 1996 and is incorporated herein by reference. Similarly, U.S. Pat. No. 6,140,602, entitled Marking Of Fabrics And Other Materials Using A Laser issuing Oct. 31, 2000 to Costin; U.S. Pat. No. 6,002,099 entitled User Control Interface For Laser Simulating Sandblasting Apparatus, issuing Dec. 14, 1999; and U.S. Pat. No. 5,916,461 entitled System And Method For Processing Surfaces By A Laser, issuing Jun. 29, 1999 to Costin et al. Hereby incorporated by reference.

Although other traditional methods, such as dyeing, printing, weaving, embossing and stamping, have been widely used, laser methods appear to have certain advantages in producing complex and intricate graphics on the materials. This is at least in part because many of the traditional methods lack the necessary registration and precision to insure that minute details of the graphics are accurately and repeatably presented on the materials. In addition, laser methods obviate many problems associated with the traditional methods such as high cost of equipment manufacturing, equipment maintenance, and operation, and environmental problems.

Denim fabrics may undergo a sandblasting process to obtain a worn look. Denim jeans are often sold with a worn look in the upper knee portions and back seat portion. The effect is similar to a feathered or shadowed look in which the degree of the worn look continuously changes along the length and width of the seemingly "worn" areas.

A sandblast treatment conventionally abrades the jeans with sand particles, metal particles or other materials at selected areas to impart a worn look with a desired degree of wear. This process blasts sand particles from a sandblasting device to a pair of jeans. The random spatial distribution of the sand creates a unique appearance in a treated area. Denim jeans and other clothing treated with such a sandblast process have been very popular in the consumer market.

However, the sandblast process has a number of problems and limitations. For example, the process of blasting sand or other abrasive particles presents significant environmental issues. A worker usually needs to wear protective gear and masks to reduce the impact of inhaling any airborne sand or other abrasive particles that are used. The actual blasting process typically occurs in a room which is shielded from other areas in a manufacturing facility. Further environmental issues arise with the clean up and disposal of the sand. In practice, undesired sand is rarely completely eliminated from the pockets of the denim jeans or jackets.

The sandblasting process is an abrasive process, which causes wear to the sandblasting equipment. Typically, the actual equipment needs to be replaced as often as after one year of normal operation. This can result in added capital expense and installation.

In addition, the actual cost of the sandblasting process is estimated as high as several dollars per unit garment depending upon capacity utilization. This high cost is at least in part due to the labor involved, the cost of the equipment repair or continual purchase, the environmental clean-up required, the sand used, and actual yield of the goods. Furthermore, the sandblasting process can adversely affect the strength and durability of the finished goods due to the abrasion of the sand or other particles that are used.

Despite the above problems and limitations, the sandblast process is still in wide use simply because there is no other alternative technique that can economically produce the desired surface appearance of the sandblast treatment. In view of the above, the inventors found it desirable to replace the sandblast process with a new environmentally friendly process which is capable of producing the "sandblast look", while reducing the cost and maintaining the durability of the finished goods.

SUMMARY OF THE INVENTION

The present invention provides an apparatus and method of treating a dyed material, wherein an unfocussed, scanning laser is passed through a mask such that a portion of the mask intersects the scanning pattern. The present invention is particularly suited to creating abrasion type fading of the sheet material. That is, the system can replicate an abraded portion of the sheet material.

In one configuration, the invention includes a support surface spaced from a scanning laser. The scanning laser is selected to project a laser beam along an optical path, wherein the optical path intersects the support surface. In addition, the scanning laser follows a given pattern or trace. A lens is disposed in the optical path intermediate the scanning laser and the support surface. The lens is selected to focus the laser beam along the optical path to a focal point. The present invention locates a mask in the optical path intermediate the lens and the focal point, the mask selected to partially occlude the given pattern. Thus, the mask is disposed intermediate the scanning laser and the focal point. By partially occluding the laser .beam prior to the focal point, the mask effectively attenuates the amount of energy impinging the sheet material at the edge of a desired pattern. Thus, by employing a mask having an aperture corresponding the shape of the desired image to be formed, the edge of the resulting image can be formed to include transition or fade from the image to the appearance of the untreated sheet material.

In further configurations, the mask is formed of a laser opaque material and includes an aperture through which a portion of the laser beam passes. The aperture in the mask can be formed to have a continuous periphery. In a further construction, the aperture in the mask is defined by a plurality of linear segments, such as saw tooth or zigzag. However, it is understood the linear segments could be curvilinear, straight or a combination of both. Thus, the present invention can be utilized to form an area of generally uniform fading, wherein the area of fading transitions to the background color in a controlled transition.

DETAILED DESCRIPTION OF THE PREFERRED EMBODIMENTS

Figure 1:
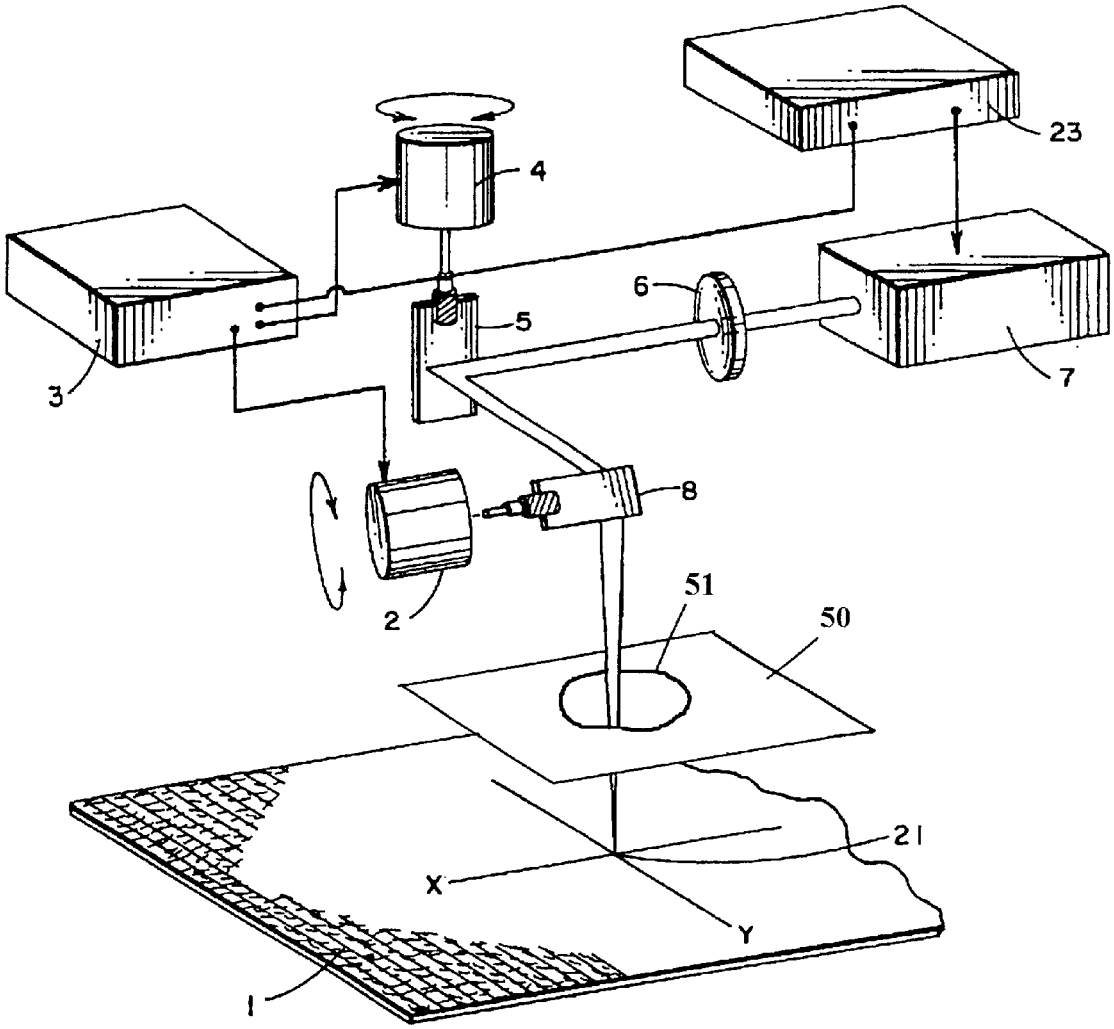
FIG. 1 is a is a perspective schematic view of a typical set up using the present invention involving a computer-controlled laser to uniformly fade or make patterns.

FIG. 1 is a schematic diagram of a textile marking apparatus. Scanning mirrors and the laser parameters, such as output power and repetition rate are set by the laser controller 23 and a Central Processing Unit (CPU) 3. The parameters for the desired pattern to be made on the textile 1 are programmed into the CPU 3. The beam position and laser intensity can be rapidly modulated to produce the desired fading effects, including but not limited to stone wash abrasion, graphic and text effects.

The CPU 3 has graphic information and formatted instructions to drive the galvanometric mirrors and control the laser parameters in order to produce the desired pattern on the textile material. As per the command sequence, a modulated or continuous laser beam originates from a laser oscillator 7. The laser oscillator 7 may be a $CO_2$, laser Nd:YAG laser, or other laser source, q-switched with an acousto-optic or electro-optic modulator. The laser beam may follow an optical system (not shown for clarity) that directs the beam onto an x-axis mirror 5 controlled by an x-axis galvanometer 4 and a y-axis mirror 8 controlled by an y-axis galvanometer 2. The beam is reflected from the x-axis mirror, which controls beam movement in the x-axis, onto the y-axis mirror, which controls beam movements in the y-axis. Preferably, the laser impinges the sheet material 1 along a scanning pattern. The scanning pattern, or trace, can be created by any of a variety of scanning mechanisms. As discussed herein and seen in FIGS. 4–7, the particular scanning pattern, or trace, can be any of a variety of patterns including raster or vector.

The laser beam propagates through a focusing lens 6 and onto the textile material 1. The focusing lens 6 can be located before or after the x and y scanning mirrors. As the x-axis and y-axis mirrors are moved, the focused laser beam 21 moves across the textile substrate as directed by the CPU 3. The focusing lens 6 causes the laser beam passing through the lens to focus to a focal point along the optical axis. Preferably, the focusing lens 6 is selected to locate the focal point adjacent the sheet material of the support surface. However, it is understood the focal point can be moved along the optical path to selectively control the energy input to the sheet material and hence amount of fading.

A mask 50 is located intermediate the focusing lens and the focal point. The mask 50 includes a laser opaque portion and a laser transmissive portion. The laser transmissive portion can be an aperture 51 or a material that allows passage of at least a portion of the laser energy. The aperture 51 can have any of a variety of peripheries and preferably includes a periphery that is generally coincident with the desired pattern to be formed on the sheet material. The aperture 51 in the mask 50 can have a continuous periphery or be defined by a plurality of linear segments. Alternative constructions of the periphery can include segments which are curvilinear or straight.

The mask 50 and aperture 51 are located intermediate the focussing lens 6 and the focal point, such that a portion of the scanning pattern intersects the periphery of the aperture 51. In addition, the mask 50 is disposed optically intermediate the scanning mechanism and the focal point. Thus, an unfocussed scanning laser passes the mask 50. Use of the mask 50, wherein the periphery of the aperture 51 intersects the laser beam optically intermediate the focussing lens and the focal point causes a predictable decline, reduction or fall off of laser intensity at the edges of the otherwise uniformly faded area on the sheet material. Although the mask 50 is described in terms of having an aperture, it is understood an opaque edge can be located to intersect the scanning beam prior to the focal point.

By selecting the shape of the uniform fade on the sheet material to be approximately the shape and area of a desired resulting "abrasion," on the sheet material, then the mask 50 in the field of the scanning beam can cause the edges of the pattern to fall off in a gradual and predictable manner. The gradual and predicted fall off of the edges (gradual fading from uniform to non-existent) is predicted in units of energy density per unit area. This energy fall off is dictated, spatially, at the edges of the pattern by the following equation:

$$fx = \int_{1}^{-\infty} Ioe^{\frac{-2r^2}{\omega^2}} dx$$

where fx=the change in irradiance between 1 (an unblocked unfocussed laser beam) and $-\infty$ (a fully blocked unfocussed laser beam), and $$Ioe^{\frac{-2r^2}{\omega^2}}$$

is the irradiance of a gaussian laser beam.

The mask 50 must be introduced at a point along the optical path after the scanning beam passes through the focussing lens 6 and prior to the laser beam reaching the optimal focus point before the beam reaches optimum focus. Thus, the mask 50 is also located intermediate the scanning mechanism and the focal point. However, it is understood the focusing lens can be located along the optical path upstream of the scanning mechanism or downstream of the scanning mechanism.

The amount of edge fade is increased as the mask is located nearer the scanning mechanism. That is, the degree of edge fade is at least partially controlled by the distance between the mask 50 and the focussing lens 6. The closer the mask 50 is to the scanning mechanism, the more gradual the edge fade that is produced. Conversely, the nearer the mask 50 is to the optimum focal point, the sharper the resulting edge transition is in the sheet material.

Figure 8:
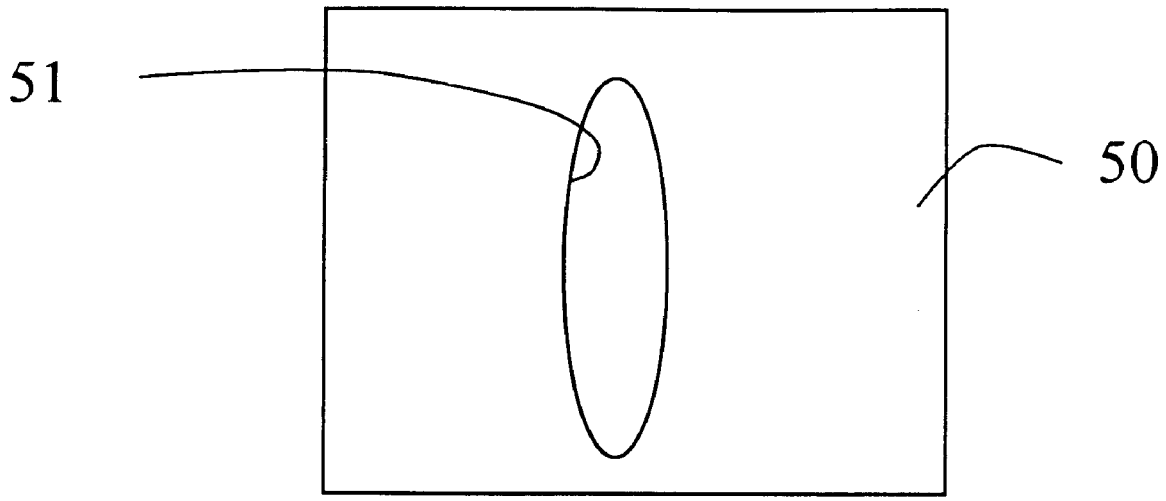
FIG. 8 is a plan view of a mask for replicating an abrasion in the sheet material.
Figure 9:
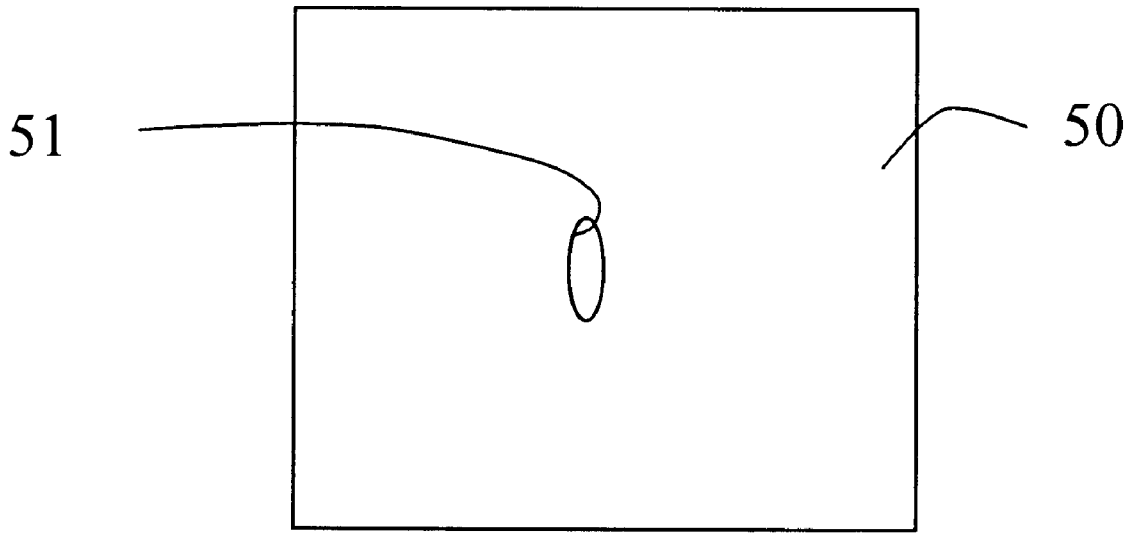
FIG. 9 is a plan view of an alternative mask for replicating an abrasion in the sheet material.

For example, as shown in FIG. 8, for an abrasion area of approximately 30 to 40 inches in length, the mask 50 can have an approximately 4 inch by 4 inch area and includes an aperture of approximately 2 inches to approximately 3.5 inches. Various and different shaped apertures in the mask can be designed to correspond to various and different shaped abrasions on the sheet material. For example, in processing jeans, the aperture can be designed to cause a wider abrasion on the thigh smoothly or abruptly narrowing at the knee and shin area of the jeans. Referring to FIG. 9, the mask 50 also having an approximately 4" by 4" size can include a small (0.25 to 1.5 inches long) elliptical aperture to cause a smaller elliptical abrasion at the knee, so that it would appear as a natural wear area at the knee.

The shape of the periphery of the aperture can also control the resulting amount of edge fade. Aperture peripheries having such shapes as sawtooth, zigzag and fingers can be introduced to the contour of the edge further controlling the amount of edge fade.

Figure 10:
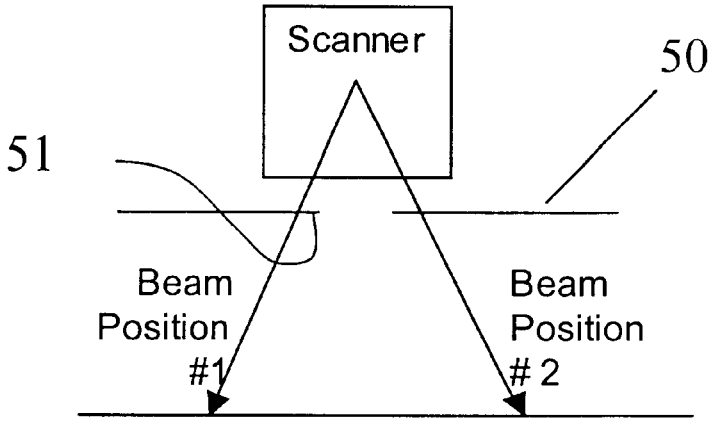
FIG. 10 is a side elevational view of an apertured mask located intermediate a focal point of the laser beam and the scanning mechanism.

As seen in FIG. 10, when the periphery of the aperture in the mask is introduced into the field at Position #1 or Position #2, the edge of the corresponding faded area is blurred or softened in accordance with the equation.

In the preferred embodiment the mask is made of sheet metal. The sheet metal is a plate roughly 4×4 inches (can be up to and near the size of the abrasion approximately 30 or 40 inches for a sharp fade edge) and anywhere from 0.003 to 0.3 inches thick. The aperture 51 in the mask 50 can be machined using conventional machine tools (mill) or cut with a laser. The material can be any rigid metal which reflects or absorbs the wavelength the laser being used.

It is also understood the mask can be a transmissive type. In this construction, an optical transmitting window can be coated with an optically reflecting or absorbing material leaving a transmission area in the shapes of the above mentioned apertures. An optically reflecting or absorbing coating can also be coated on the optical window with a gradient fall off at the aperture edge.

Using the present invention broadly could achieve a stonewash appearance with an abrasion area on a textile or jeans. In addition, this appearance is provided with much less water use or damage to the textile material than that which occurs through actual stone washing.

Figure 11:
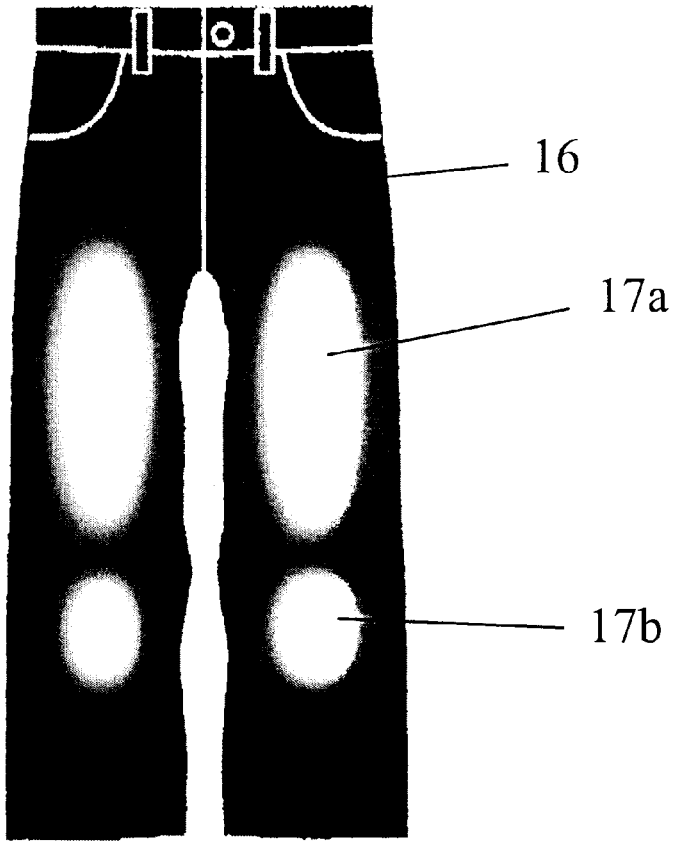
FIG. 11 is a frontal view of dungarees made using this method showing selected patterns made by a laser.

FIG. 11, shows a pair of denim jeans 16 which has been subjected to this method for laser marking and treatment of textile materials. On the jeans 16 are shown two different patterns, one being a relatively large abrasion 17*a* and a smaller abrasion 176. It is contemplated that this inventive process may be implemented in the manufacture of textile material prior to being cut into clothing forms, and during the transport of such uncut material on a conveyor belt during the manufacturing process.

A second type of pattern that is shown is the stone wash pattern. This type of pattern would also result for the set up illustrated in FIG. 1. Depending on the intensity of the beam and the time it is allowed to remain on the textile, the patterns illustrated in FIG. 11 could be the result of selective photo-decomposition resulting in a white or faded appearance where the pattern is located on the denim. Experiments have been done using the Nd:YAG laser with a wavelength of around 1064 nanometers and a $CO_2$ 10600 nm. The laser beam may be generated by a frequency doubled Nd:YAG laser having a wavelength of approximately 532 nm.

Other possible wavelengths for other laser sources range between 190 nanometers to 10600 nanometers. An Excimer laser may operate effectively at wavelengths 196 nm to 235 nm, or a $CO_2$ laser may operate effectively at 10600 nanometers. The wavelength of the laser should be chosen such that it is strongly absorbed by the dye to be faded but not by the textile material. The range of pulse duration used has been from 5 nanoseconds to 100 microseconds, with the best results being from 20 to 350 nanoseconds. Other variables, such as the pulse energy, peak power, scan speed, dot pitch, and energy density play an important factor in the degree of photo-decomposition and the avoidance of damage to the textile material 1.

For example, these variable parameters may include the laser beam having a repetition rate from 1 hertz to 500 MHz ($500\times10^6$ hertz), a pulse duration between approximately 10 fs ($10\times10^{-15}$ seconds) to 500 ms ($500\times10^{-3}$ seconds), in addition ranges from 5 nanoseconds to continuous are possible, in that the laser may have a continuous output beam and is classified as a CW laser, or the laser have a scan speed of 1 mm per minute to 500 meter/second, and a dot pitch between 0.1 um to 5 meters. A preferred range for the pulses is from 20 nanoseconds to approximately 1 millisecond.

Figure 2:
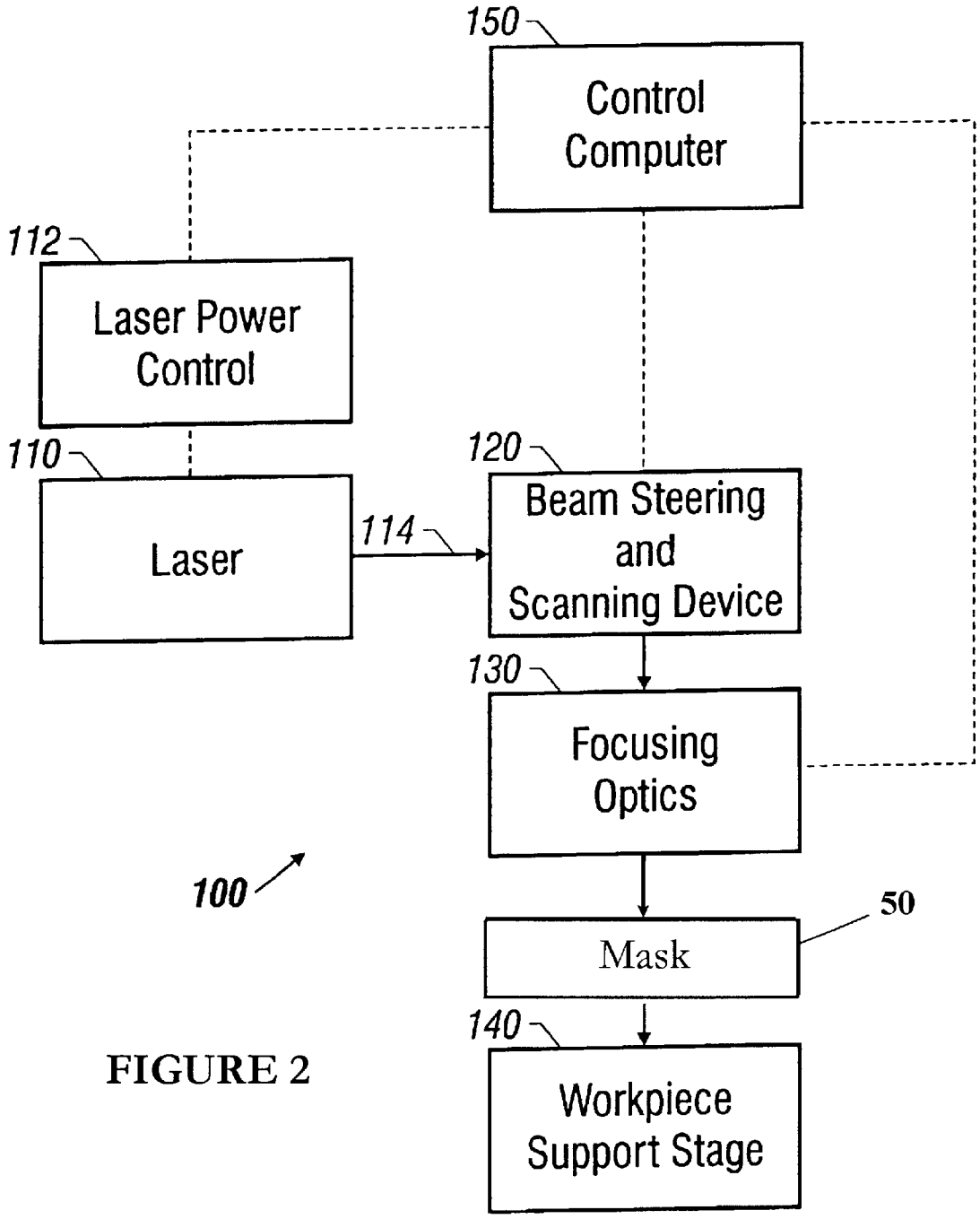
FIG. 2 is a schematic diagram showing an alternative configuration for treating a surface of a workpiece.

It is understood alternative constructions can be employed. FIG. 2 shows a block diagram of an alternative laser processing system 100 for treating a surface in accordance with the invention. Solid lines with an arrow represent laser beams and dashed lines represent electrical control signals. A laser 110 of any type, including but not limited to, a gas laser and a solid-state laser in CW or pulsed operation mode, produces a laser beam 114. A $CO_2$ laser may be preferred for processing many materials. The output power of the beam 114 is controlled by a laser power control unit 112. A beam steering and scanning device 120 is positioned relative to the laser 110 and is operable to guide the laser beam to any location on a workpiece surface held by a support stage 140. Focusing optics 130 is located at a desired distance from the support stage 140 relative to the beam steering and scanning device 120. The focussing optics causes a convergence of the laser beam to a point along the optical axis. Preferably, the focal point is selected to occur at the sheet material.

The mask 50 is located intermediate the focussing optics 130 and the work piece support stage 140. The mask 50 is as previously disclosed and is located such that a portion of the aperture 51 periphery intersects the scanning path of the laser beam.

A control computer 150 is used to control the operation of the laser 110 including the output power, the steering and scanning of the laser beam, and the beam spot size on the support stage by changing the distance between the focusing optics 130 and the support stage 140. The control of the output power of the laser 110 includes turning on/off the laser beam, changing the output level, or other controls. Such a control can be done either by directly controlling the laser itself or by modulating the output beam with a electrically driven beam shutter and beam attenuator.

The beam steering and scanning device 120 can either direct the beam to any desired location on the support stage 140 or scan the beam over the support stage with a certain spatial sequence at a desired speed. Thus, the preferred system 100 in general can be used for scribing a pattern on a surface and treating a surface to achieve a certain appearance or achieving a combination of the both.

A variety of materials can be processed with the system 100, including but not limited to, fabrics, leathers, vinyls, rubber, wood, metals, plastics, ceramics, glass, and other materials. These materials can be used to make different goods. Some common examples include clothing, linens, footwear, belts, purses and wallets, luggage, vehicle interiors, furniture coverings, and wall coverings.

Figure 3:
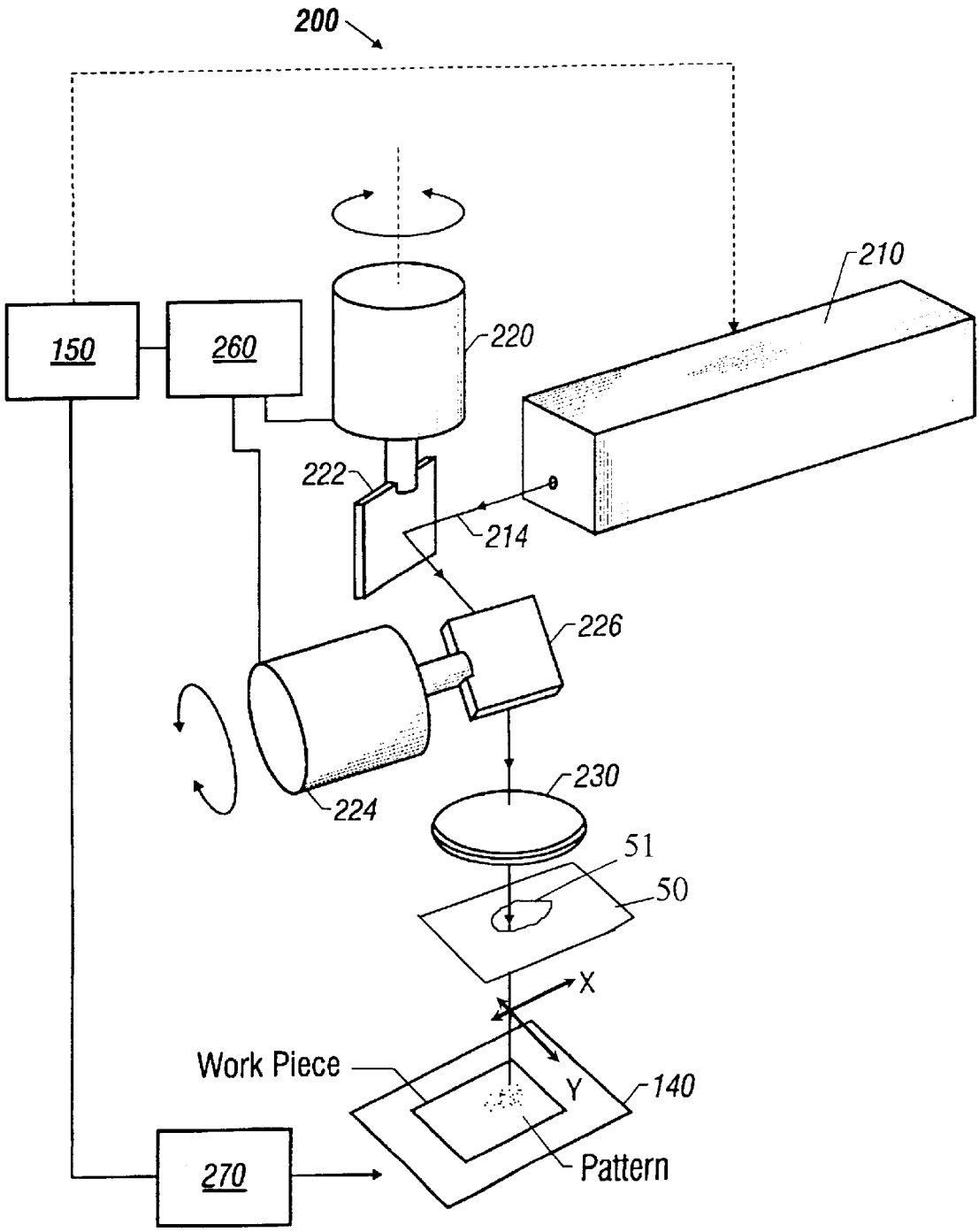
FIG. 3 is an implementation of the configuration of FIG. 2 with two galvo mirrors for scanning the laser beam on a workpiece surface.

FIG. 3 shows an exemplary implementation 200 of the system 100. A laser 210 can be a $CO_2$ laser or a YAG laser capable of producing different power outputs. An electrically controlled beam shutter (not shown) is included in the laser 210 to turn the beam on and off as desired. A CW $CO_2$ laser, "Stylus", manufactured by Excel/Control Laser (Orlando, Fla.) may be used as the laser 210. The laser 210 generates a laser beam 214 in the direction of a computer controlled beam steering and scanning device having a first mirror 222 and a second mirror 226. The mirror 226 is mounted on a first galvanometer 220 so that the mirror 226 can be rotated to move the beam in a x-axis on the support stage 140. A second galvanometer 224 is used to control the mirror 226 so that the mirror 226 can move the beam on the support stage 140 along a y-axis. Therefore, galvo mirrors 222 and 226 can be controlled to scan the laser beam on the support stage to generate almost any trace and geometric shapes as desired. A galvanometer driver 260 receives commands including numerical control commands from the computer 150 and respectively controls the movement of each galvo mirror.

The laser beam 214 is deflected first by the x-axis mirror 222 and subsequently by the y-axis mirror 226 to direct the beam through a focusing lens 230. The lens 230 is preferably a multi-element, flat-field, focusing lens assembly, which is capable of optically maintaining the focused spot on a flat plane as the laser beam moves across the sheet material.

The mask 50 is located as previously described along the optical path and includes the desired aperture 51 periphery configuration, as well as any periphery contours. In addition, the mask 50 is located relative to the stage 140 and the focussing lens 230 to provide the desired rate of fade or power attenuation impinging the sheet material.

A movable stage (not shown) may be used to hold the lens 230 so that the distance between the lens 230 and the support stage 140 can be changed to alter the beam spot size as well as the focal point along the optical path. Alternatively, the support stage may be moved relative to the lens 230.

The support stage 140 has a working surface which can be almost any substrate including a table, or even a gaseous fluidized bed. A workpiece is placed on the working surface. Usually the laser beam is directed generally perpendicular to the surface of the support stage 140, but it may be desirable to guide the beam to the surface with an angle to achieve certain effects. For example, the incident angle may range between about 45° and about 135°. The computer 150 may include a designated computer such as a workstation computer (not shown) to facilitate the formation of the desired graphic or a control matrix. For example, a graphic can be scanned into the workstation computer and converted into the proper format to expedite the processing speed.

Figure 4:
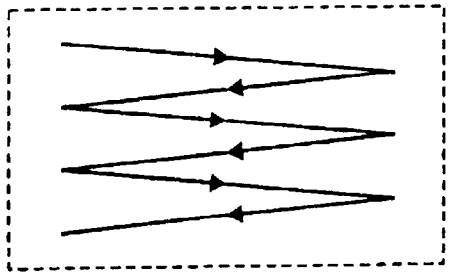
FIG. 4 is a schematic of an exemplary laser scanning trace.
Figure 5:
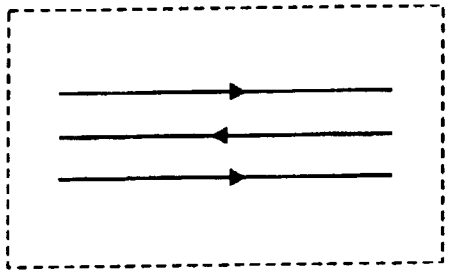
FIG. 5 is a schematic of a further laser scanning trace.
Figure 6:
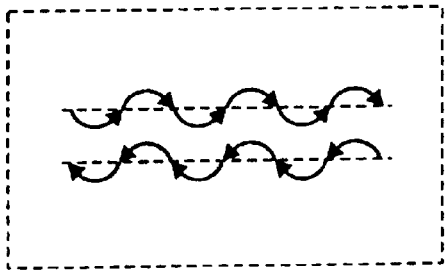
FIG. 6 is a schematic of an alternative laser scanning trace.
Figure 7:
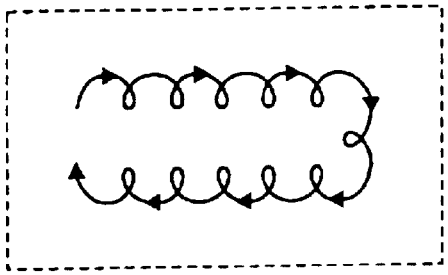
FIG. 7 is schematic of an additional laser scanning trace.

According to the invention, multiple laser scanning passes are performed in treating a selected section of a sheet material or surface. In general, any beam scanning scheme can be employed in the invention. For example, a commonly used line scanning scheme may be used to scan a surface in a line-by-line manner with each scanning line being a substantially straight line. FIGS. 4 and 5 show two examples of scanning in straight lines. Referring to FIGS. 6 and 7, non-straight scanning lines may also be used to achieve certain surface appearance that may not be possible with straight scanning lines. In particular, scanning in non-straight lines may be used to enhance the feathering effect on a fabric. Referring to FIG. 2, the beam steering and scanning device 120 and/or the focusing optics 130 may be controlled with the control computer 150 so that the trace of the scanning beam on a surface forms a certain waveform pattern. FIG. 6 shows a sine or cosine type scanning line. FIG. 7 shows "wobbling" scanning lines. Two adjacent wobbling lines may or may not overlap with each other. The wobbling scanning lines can be used in the scaling technique to compensate for the increased scanning spacing due to the increase in the size of an area to be processed.

The present system does not degrade the sheet material to the extent of a normally occurring abrasion area, but rather mimics the resulting fade pattern. Thus, the invention can create localized "abrasions" in the sheet material, wherein the transition from the unfaded material to the fade of the abrasion in the material can be controlled in a manner to replicate an abrasion.

It has been found that use of the $CO_2$ laser on dyed cotton threaded textiles causes a vaporization or ablation of the dye without significantly damaging the threads. That is, the laser energy impacted on the sheet material is greater than the vaporization/ablation threshold level of the dye in the cotton threads but is less than the vaporization/ablation threshold level for the cotton threads. Conversely, use of the Nd:YAG laser tends to photo-decompose or photo bleach the dye in the cotton threads.

The present invention also contemplates creation of an abrasion replication in the dyed textile through the use of software control of the laser. For example, commercially available software such as Adobe PhotoShop™ can be used to create the desired abrasion impression. Specifically: the steps include:

1.1 Open a new file of the size (inches) and dot density (100 dpi is preferred) desired for the localized abrasion to be on the denim garment or panel.
- 1.1.1 Select the "Ellipse Marquee" tool from the Tool Bar.
- 1.1.2 Set the "Feather Pixels" on the Marquee Options Tool Bar to the desired amount of edge fade required for the desired effect on the abrasion (usually somewhere between 5 pixels and 50 pixels—preferred is 20 pixels)
- 1.1.3 Click and drag the mouse over the File Window such that the ellipse marquee covers the central area of the window.
- 1.1.4 Select the "Paint Bucket" tool from the Tool Bar and select the color to be black.
- 1.1.5 Click mouse in the center of the elliptical marquee area. This creates a nice symmetrical abrasion with even fall off of intensity around the edges.
- 1.1.6 If a non symmetrical abrasion is desired, the "Paint Brush" tool on the Tool Bar can be used to make the abrasion graphic non symmetrical.

1.2 Reduce the color depth of the Abrasion Graphic
- 1.2.1 Select "Image" then "Mode" then "Bitmap" from the Menu Bar.
- 1.2.2 Select "Diffusion Dither" in the Dialog Box.
- 1.2.3 Make sure that input resolution is equal to output resolution.
- 1.2.4 Click on "OK"—Color depth is now reduced to 2 colors (black & white)
- 1.2.5 Save the image in a directory with the Icon Software Program BMP2PLT.

1.3 Convert the BMP file to a PLT using Icon's BMP2PLT program
- 1.3.1 From File manager, start the BMP2PLT program.
- 1.3.2 Input the file name of the abrasion graphic then hit enter.
- 1.3.3 The graphic file format of the abrasion has now been converted to HPGL (PLT) for laser finishing with Prolase™

An alternative method for producing the abrasion appearance includes selectively altering the location of the focal point relative to the sheet material. Generally, the laser beam is brought out of focus at the areas where transitional fading is desired. More particularly, this is referred to as Z-axis focus control.

Z-axis focus control is a configuration available on some commercially available laser marking systems. A moveable, computer programmed, focusing system can be programmed to vary the focus across the scan field. The focusing system is programmed to defocus the beam as the beam nears the edges of the graphic being marked.

1.4 A solid elliptical graphic is generated using a drawing program (PhotoShop™ is the preferred program). The procedure above can be used with the omission of step 1.1.2 (this is the step which causes the edge fade)

1.5 The graphic is loaded into a laser marking system which has Z-axis correction.

1.6 Z-axis correction is accomplished by setting up a look up table which controls the focus position across the field of the laser.

1.7 The z-axis software program is programmed to defocus the laser beam as the beam is scanned near the edges. The net effect is an even fall off of intensity around the edges.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

What is claimed is:

1. An apparatus for selectively fading a dyed cotton textile, comprising:

(a) a support surface;

(b) a scanning laser selected to project a laser beam along an optical path, the optical path intersecting the support surface and following a given scanning pattern;

(c) a lens in the optical path intermediate the scanning laser and the support surface, the lens selected to focus the laser beam along the optical path to a focal point; and (d) a mask in the optical path intermediate the lens and the focal point, the mask selected to occlude a portion of the given scanning pattern.

2. The apparatus of claim 1, wherein the mask includes an aperture having a periphery, wherein a portion of the aperture periphery intersects the scanning pattern.

3. An apparatus for treating a sheet material, comprising:

(a) a support surface;

(b) a scanning laser selected to project a laser beam along an optical path, the optical path intersecting the support surface and following a given pattern;

(c) a lens in the optical path intermediate the scanning laser and the support surface, the lens selected to focus the laser beam along the optical path to a focal point; and (d) a mask in the optical path intermediate the lens and the focal point, the mask selected to partially occlude the given pattern.

4. The apparatus of claim 3, wherein the mask is formed of a laser opaque material and includes an aperture through which a portion of the laser beam passes.

5. The apparatus of claim 4, wherein the aperture in the mask has a continuous periphery.

6. The apparatus of claim 4, wherein the aperture in the mask is defined by a plurality of linear segments.

7. The apparatus of claim 6, wherein the linear segments are one of curvilinear or straight.

8. The apparatus of claim 3, further comprising a controller connected to the laser, the controller directing the given pattern of the optical path relative to the support surface.

9. The apparatus of claim 8, wherein the controller directs the optical path to follow a raster pattern or a curvilinear pattern.

10. The apparatus of claim 3, wherein the mask includes a laser transmissive portion and a laser opaque portion.

11. The apparatus of claim 8, wherein the given pattern intersects the laser opaque portion.

12. The apparatus of claim 3, wherein the mask includes an aperture defined by a circular, oval, elliptical, or a curvilinear periphery.

13. The apparatus of claim 3, wherein the mask includes an aperture having a plurality of slits.

14. The apparatus of claim 3, wherein the mask includes an aperture selected to replicate one of an abrasion, fading, stone washing, ball washing or acid washing of the sheet material.

15. A method of treating a sheet material, comprising:

(a) passing a laser beam through a lens to focus the laser beam to a focal point along an optical path;

(b) scanning the laser beam to follow a given pattern;

(c) occluding a portion of the optical path intermediate the lens and the focal point to create a modified laser beam; and (d) impinging the modified laser beam on the sheet material.

16. The method of claim 15, wherein impinging the laser beam on the sheet material includes locating a denim material in the optical path.

17. A method of varying an energy density of a laser beam impinging a sheet material, comprising:

(a) focussing a scanning laser beam to a focal point along an optical path, the optical path following a scanning pattern; and (b) passing the scanning laser beam through a mask prior to the laser beam reaching the focal point along the optical axis, the scanning pattern intersecting a portion of the mask.

* * * * *